US006149121A

United States Patent [19]

Barton, Jr.

[11] Patent Number: 6,149,121

[45] Date of Patent: Nov. 21, 2000

[54] APPARATUS FOR FORMING UNLINED PASSAGES THROUGH CONCRETE WALLS

[76] Inventor: Bruce G. Barton, Jr., 10823 Plaza Dr., Whitmore Lake, Mich. 48189

[21] Appl. No.: 08/246,804

[22] Filed: May 20, 1994

Related U.S. Application Data

[60] Continuation of application No. 08/119,954, Sep. 10, 1993, abandoned, which is a division of application No. 07/745, 548, Aug. 15, 1991, abandoned.

[51] Int. Cl.[7] ..... B28B 7/28

[52] U.S. Cl. ..... 249/39; 249/177; 249/184; 249/186

[58] Field of Search ..... 249/39, 43, 144, 249/156, 177, 184, 186, DIG. 2; 52/215

[56] References Cited

U.S. PATENT DOCUMENTS

| | | | |
|---|---|---|---|
| 799,171 | 9/1905 | Kuhn | 249/186 |
| 963,984 | 7/1910 | Besser | 249/184 |
| 1,290,972 | 1/1919 | Goodleft et al. | 249/186 |
| 1,580,518 | 4/1926 | Martine | 249/186 |
| 1,746,696 | 2/1930 | Dows . | |
| 2,234,784 | 3/1941 | Stolz . | |
| 2,286,564 | 6/1942 | Newell . | |
| 2,694,847 | 11/1954 | Christiansen | 249/61 |
| 2,753,611 | 7/1956 | Schafer et al. | 249/184 |
| 2,968,855 | 1/1961 | Stolz . | |
| 3,265,349 | 8/1966 | Hamrick . | |
| 3,328,055 | 6/1967 | Lang | 249/177 |
| 3,523,552 | 8/1970 | Ogden | 249/150 |
| 3,528,668 | 9/1970 | Barton . | |
| 3,729,165 | 4/1973 | Trimble | 249/184 |
| 4,077,599 | 3/1978 | Oland | 249/186 |
| 4,084,780 | 4/1978 | Mess | 249/186 |
| 4,138,084 | 2/1979 | Reid | 249/184 |
| 4,348,344 | 9/1982 | Nobbe | 264/333 |
| 4,427,173 | 1/1984 | MacKay | 249/177 |
| 4,625,940 | 12/1986 | Barton . | |
| 4,997,602 | 3/1991 | Trimble | 249/184 |
| 4,998,705 | 3/1991 | Cass | 249/39 |
| 5,017,313 | 5/1991 | Trimble | 249/184 |
| 5,182,885 | 2/1993 | Barton, Jr. . | |

FOREIGN PATENT DOCUMENTS

| | | | |
|---|---|---|---|
| 3508706 | 12/1985 | Germany | 249/184 |
| 1541196 | 2/1979 | United Kingdom | 264/317 |

OTHER PUBLICATIONS

Thunderline Corp. Catalog No. LS–119–G, p. 6, 1985.

*Primary Examiner*—James P. Mackey
*Attorney, Agent, or Firm*—Brooks & Kushman P.C.

[57] ABSTRACT

Apparatus for creating a sleeveless passage of controlled size and shape through a concrete wall poured in a form including two form plates mounted in fixed, spaced relation separated by a width W comprises a plurality of modular, one piece passage units, each unit including an annular main shell of external size and shape conforming to a segment of the sleeveless passage; each unit has end closure walls closing the ends of the main shell. Each modular unit has an axial length L1 that is smaller than W. Each modular unit also has interlock elements that interconnect with another like modular unit so that the main shells of the units can be aligned with each other in one integral assembly between the two form plates.

14 Claims, 3 Drawing Sheets

Fig. 1
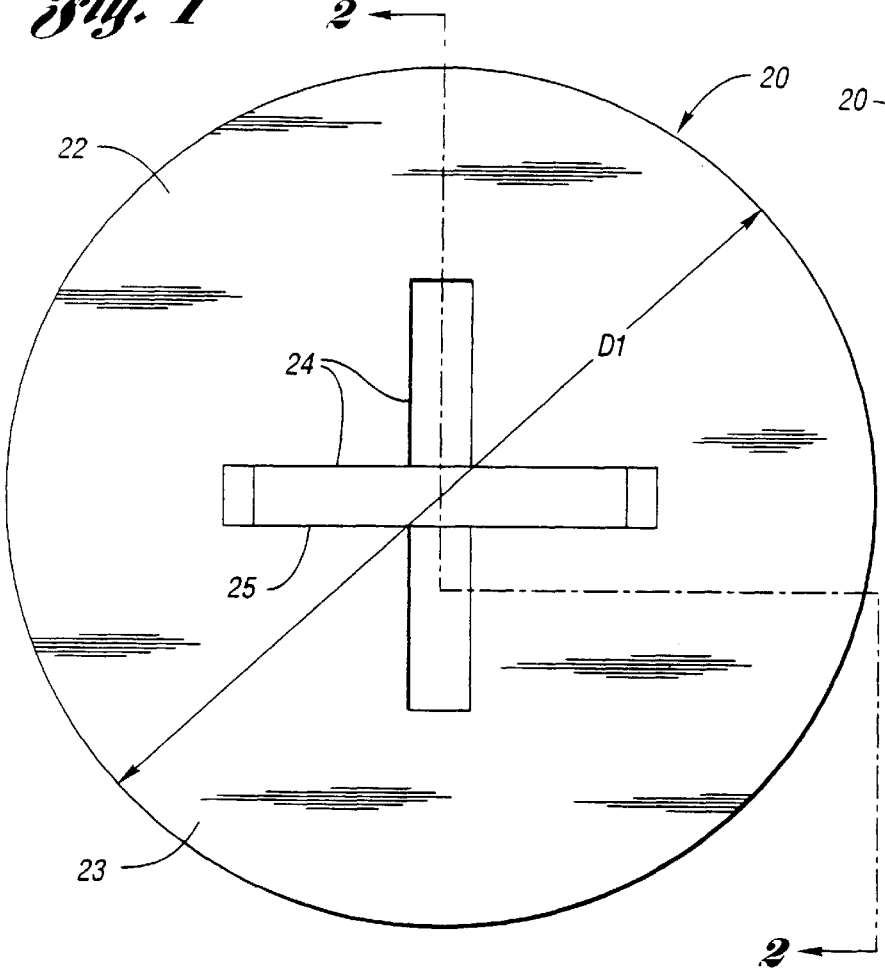
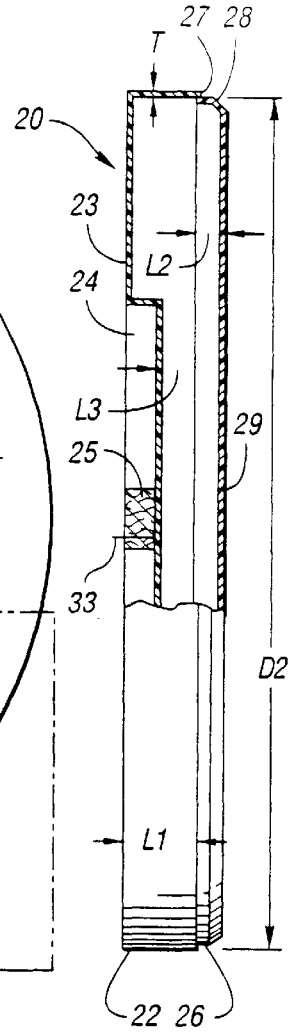
Fig. 2
Fig. 3
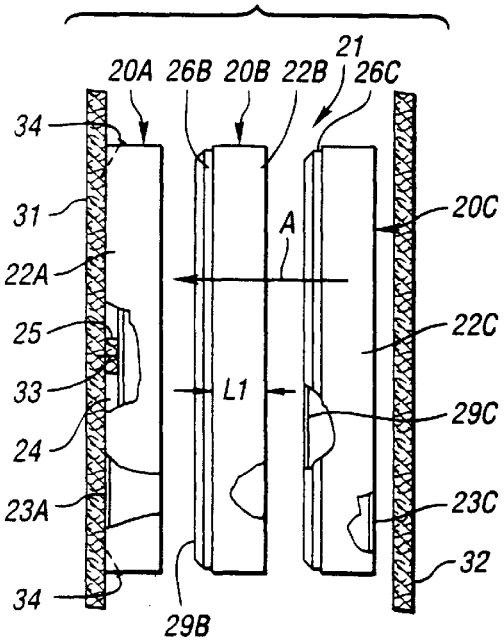
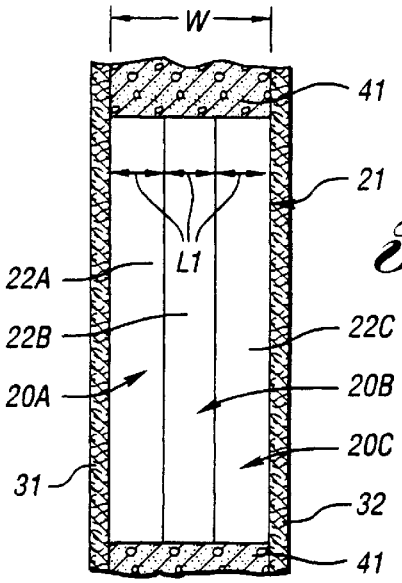
Fig. 4

Fig. 5
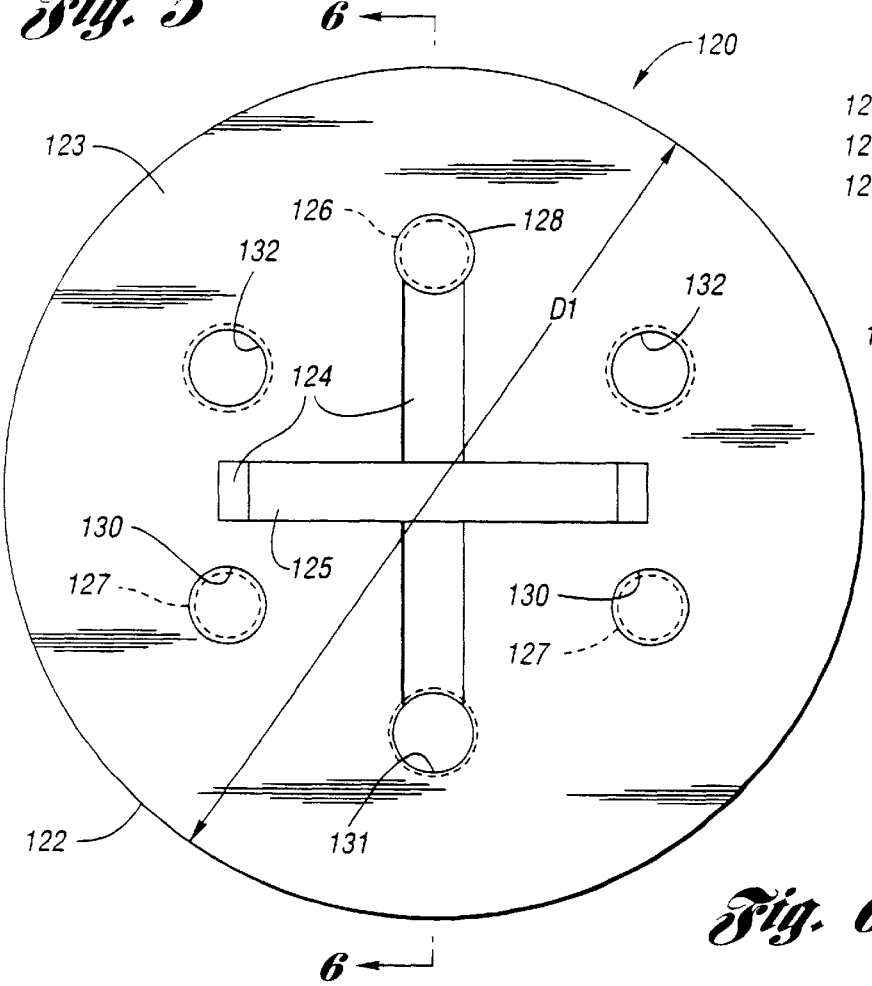
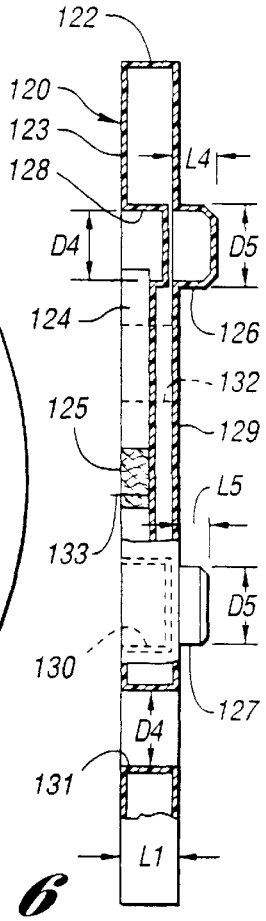
Fig. 6
Fig. 7
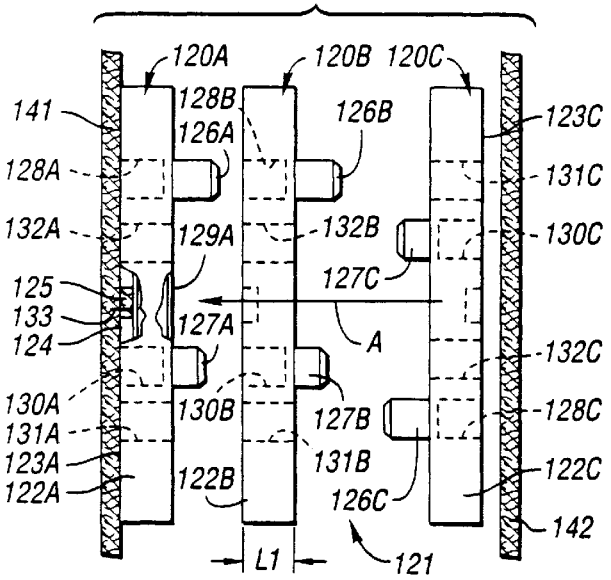
Fig. 8
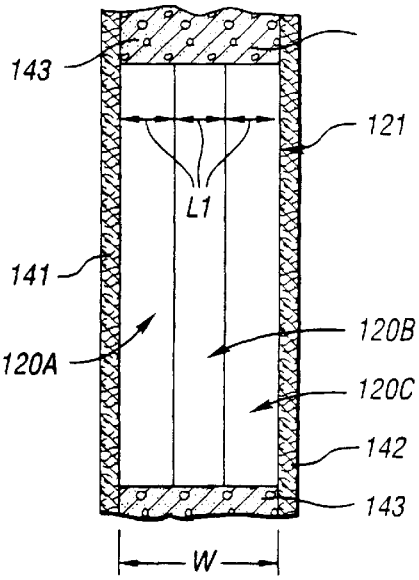

APPARATUS FOR FORMING UNLINED PASSAGES THROUGH CONCRETE WALLS

This is a continuation of application Ser. No. 08/119,954 filed Sep. 10, 1993, which was a division of application Ser. No. 07/745,548 filed Aug. 15, 1991. Both prior applications are now abandoned.

BACKGROUND OF THE INVENTION

In this specification and in the appended claims, a "wall" may be horizontal, vertical, or at any desired angle; thus, a "wall" may be a floor, a ceiling, or a roof.

In new construction, whether for commercial, residential, industrial, bridge, road, or other use, it is often necessary to extend a pipe or conduit for a water, gas, or electrical line through a concrete wall. It is frequently desirable or even mandatory to provide a hydrostatic seal around the pipe or conduit to preclude seepage of water or other fluid through the wall. The most practical and effective seal construction for applications of this kind, in most instances, is an expansion seal formed of a series of interleaved blocks of rubber or other elastomer interconnected by a sequence of pressure plates, with a plurality of bolts extending between the pressure plates; the bolts are tightened to squeeze the elastomer blocks between the pressure plates, expanding the blocks to form a continuous hydrostatic seal around the pipe. A preferred construction for a wall seal closure of this kind is disclosed in U.S. Pat. No. 3,528,668 of Bruce G. Barton. Other wall closure seal constructions for forming peripheral seals on pipes and conduits are also known in the art.

To assure an effective seal, in applications of this kind, it is highly desirable and often necessary to form a passage through the wall, through which the pipe or conduit can extend, with an internal diameter large enough to afford an essentially symmetrical annular space between the pipe and the passage surface. The diameter of the wall passage may vary to a substantial extent, depending upon the outside diameter of the pipe or conduit and the particular seal to be used. Thus, the internal diameter required for the wall opening may range from under two inches to ten feet or even more. For most constructions of this kind, in concrete walls, a sleeve anchored in and extending through the concrete wall has been employed.

One practical and effective sleeve construction for concrete walls is a metal tube having a length equal to the width of the wall and having an annular metal flange welded to the outside central portion of the metal sleeve. The flange serves as a water stop that precludes water seepage along the outer surface of the sleeve, at the interface between the sleeve and the concrete wall. The flange also serves as an anchor that precludes axial movement of the wall sleeve. This metal wall sleeve construction, however, presents technical difficulties relating to accurate location of the sleeve and prevention of entry of concrete or debris into the sleeve when the wall is poured. There is also a requirement for a substantial inventory of sleeves of differing lengths; the wide variations in wall width and in required sleeve diameter produce too many combinations for an economical sleeve inventory. Further, corrosion and sleeve weight are continuing problems.

Another wall sleeve construction, one which effectively overcomes many of the disadvantages of steel wall sleeves, is disclosed in U.S. Pat. No. 4,625,940 of Bruce G. Barton. That wall sleeve starts with a molded resin precursor having cup-like end caps of an outside diameter D formed integrally with the opposite ends of a main sleeve having an inside diameter D. In use, the end caps are cut off the main sleeve and mounted in a concrete form, with the sleeve section fitted onto the two cap sections. When the wall has been poured and set, the end caps are removed along with the concrete form, leaving a wall sleeve suitable for use with a conduit and expandable seal, as described above.

The wall sleeve precursors of U.S. Pat. No. 4,625,940 can be used to produce a long wall sleeve by cutting off the end wall of a cap section on one sleeve precursor and inserting it into the end of another precursor from which the complete cap section has been removed. But the resulting extended sleeve leaves much to be desired. At best, if the two precursors are joined by a thermal weld there is usually a ridge inside the joint and an appreciable reduction in inside diameter. The joint is not usually as strong as desired. Auxiliary fasteners such as self-tapping screws are often needed, along with a messy external sealant. Screws or other fasteners may project into the sleeve and create an appreciable obstruction in it. Labor expense is substantial, and scrap is usually undesirably high.

Another wall sleeve system, which provides appreciable improvements and affords an unobstructed wall sleeve of extended length with strong sealed joints, minimal labor costs, and no screws or other fasteners, is disclosed in Bruce G. Barton Jr. U.S. patent application Ser. No. 7/645,805 filed Jan. 25, 1991, now U.S. Pat. No. 5,182,885 issued Feb. 2, 1993. In that system a cylindrical wall sleeve assembly forming an unimpeded passageway of consistent internal diameter through a concrete wall of given width comprises a first unitary one-piece cylindrical molded resin sleeve member having an internal diameter D1; a joint end of the first sleeve member terminates in a substantially flat radial flange having an external diameter D2, with D2>D1. There is also a second unitary one-piece cylindrical molded resin sleeve member having an internal diameter D1; a joint end of the second sleeve member terminates in a substantially flat radial flange having an axially projecting outer rim with an internal diameter D2. The joint ends of the first and second sleeve members are firmly secured to each other with their radial flanges in abutting engagement to afford an assembled sleeve having an overall length approximately equal to the wall width. Finally, there are a pair of end members, each including a cylindrical body having an external diameter D1 to fit tightly into an open end of the assembled sleeve, each end member having a substantially flat radially outwardly projecting mounting flange at its outer end which limits insertion of the end member into the sleeve; the end member flanges comprise mounting means for mounting the assembly in fixed position between the opposed walls of a concrete form while allowing removal of both end members, upon dismantling of the form, for full exposure of the interior of the sleeve.

All of these systems provide passages through concrete walls that are well adapted to use with the seal of U.S. Pat. No. 3,528,668, but all have continuing problems. For steel sleeves, weight, cost, and corrosion, and some water leakage, are the principal difficulties. For resin sleeves, inadequate structural integrity in large sizes (commercial resin sleeves are pretty well limited to wall openings of less than twenty-five inches diameter) and poor bonding to the concrete, along with water leakage and through-wall fire limitations are common problems. The aim of this invention is to eliminate these problems, in part by eliminating wall sleeves. The invention also makes possible inexpensive, efficient formation of unlined apertures through concrete walls as may be necessary for culverts, outfall revetments, etc.

SUMMARY OF THE INVENTION

It is a main object of the invention, therefore, to provide a new and improved apparatus and system for forming a smooth, unlined, sleeveless passage through a concrete wall, a passage well suited to installation therein of a wall seal closure such as that of Barton U.S. Pat. No. 3,528,668.

Another object of the invention is to provide a new and improved apparatus and system for forming an unlined, sleeveless passage through a concrete wall that is simple and inexpensive and that avoids or minimizes the difficulties of the prior art as described above.

Another main object of the invention is to provide a new and improved unitary, one-piece molded resin wall passage unit that can be readily and inexpensively employed, with other such units, to form an improved wall passage unit stack of extended length that can be used to form an unlined, sleeveless passage of consistent internal diameter through a concrete wall of virtually any thickness.

A further object of the invention is to provide a new and improved system of unitary, one-piece molded resin wall passage units that can be joined together in a wall passage stack, usually of large diameter, and used to form a passage of consistent internal diameter through a concrete wall, in an arrangement that eliminates any need for screws or other fasteners, that minimizes costs, and that affords adequate structural integrity during pouring of a concrete wall.

Accordingly, the invention relates to a modular passage unit adapted to be mounted in a concrete wall form with other such units to create a passage of controlled size and configuration through a concrete wall molded in the concrete wall form, the concrete form including first and second form plates mounted in fixed spaced relation to each other and separated by a spacing W, the modular passage unit being of generally drum-like configuration and comprising an annular main shell having a size and configuration conforming to an axial segment of the desired passage through the concrete wall and having a given axial length L1, with L1<W;

a front unit closure wall, closing off a front face of the main shell;

the front unit closure wall including means for mounting the modular passage unit in predetermined position on the inner surface of the first form plate of the concrete wall form with at least the outer rim of the modular passage unit sealed against that inner surface;

a rear unit closure wall closing off the rear face of the main shell;

and interlocking means for interconnecting the modular passage unit with a second modular passage unit of like size and configuration so that the main shells of the two passage units are aligned with and immediately contiguous with each other within the concrete wall form;

the main shell, the front unit closure wall, the mounting means, the rear unit closure wall, and the interlocking means all comprising one integral unit.

BRIEF DESCRIPTION OF THE DRAWINGS

FIG. 1 is a front elevation view of a one piece modular passage unit according to one embodiment of the invention;

FIG. 2 is a partly sectional side elevation view taken approximately along line 2—2 in FIG. 1;

FIG. 3 is an exploded view, on a reduced scale, of three of the modular one piece passage units of FIGS. 1 and 2 prior to assembly in a wall passage stack in a form for a concrete wall;

FIG. 4 shows the stack of FIG. 3 in assembled condition;

FIG. 5 is a front elevation view of a modular one piece passage unit according to another embodiment of the invention;

FIG. 6 is a partly sectional side elevation view taken approximately along line 6—6 in FIG. 1;

FIG. 7 is an exploded view, on a reduced scale, of three of the modular one piece passage units of FIGS. 5 and 6 prior to assembly in a wall passage stack in a form for a concrete wall;

FIG. 8 shows the stack of FIG. 7 in assembled condition;

DESCRIPTION OF THE PREFERRED EMBODIMENTS

Figure 9:
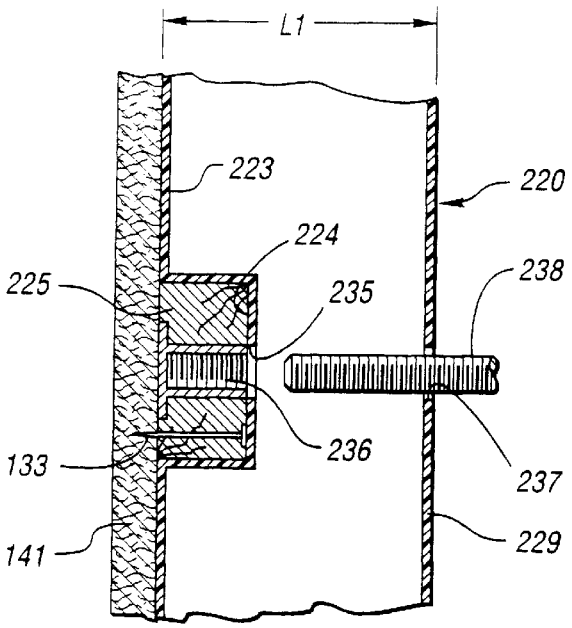
FIG. 9 is a detail elevation view, in cross-section, of a modification of the modular one piece passage unit of FIGS. 5–8.

FIGS. 1 and 2 illustrate the construction of a modular one piece passage unit 20 according to a first preferred embodiment of the invention. FIG. 3 shows three such units 20A, 20B and 20C, on a reduced scale, aligned and ready for assembly in a wall passage stack in a form for a concrete wall. FIG. 4 shows the same units 20A–20C in a stack 21 in the form, as they are during pouring and setting of the concrete and immediately prior to removal from the wall. FIGS. 1–4 represent a first system according to the invention and are described together.

This first system for forming an unlined, sleeveless passage of a controlled size and configuration through a concrete wall uses a plurality of modular one piece passage units 20, FIGS. 1 and 2. These units are assembled in a stack 21 (FIGS. 3 and 4) shown as including three units 20A, 20B and 20C. The assembled stack 21 will always include at least the two modular passage units 20A and 20C at the ends of the stack; the number of units 20B in the middle of stack 21 can vary substantially, depending on the width W of the concrete wall (FIG. 4).

The modular one piece passage unit 20, FIGS. 1 and 2, is of generally drum-like shape, including an annular main shell 22 of external diameter D1 and axial length L1. Diameter D1 becomes the internal diameter of the wall passage, as will be made apparent. Typically, diameter D1 may range from a few inches up to several feet; maximum value for the system is for wall passages requiring an internal diameter in excess of eighteen inches. Length L1, on the other hand, is usually best maintained at about two, three, or four inches so that virtually any wall thickness can be accommodated. For most systems lengths L1 of three and four inches are best.

A front closure wall 23 closes off the front face of the main shell 22 of unit 20. At the center of the end closure wall 23 there is an alignment recess 24. The dimensions of recess 24 are preferably such that a short length 25 of a conventional 2×4 wood stud (actually 1.5"×3.5") fits into the recess. Recess 24 need not be of the illustrated cross shape; a linear recess can be employed if preferred.

At the rear of unit 20, as shown in FIG. 2, a small transition flange 27 connects the main shell 22 of unit 20 to an alignment shell 26. The axial length L2 of alignment shell 26 should be appreciably less than the main shell length L1.

Indeed, L2 should be less than the differential axial length L3 from the inside surface of recess 24 to the inside surface of the rim 27 of main shell 22. The outside diameter D2 of alignment shell 26 should enable that part of unit 20 to fit into the main shell 22 of another like assembly unit. Thus, D2 D1−2T. A small taper 28 may be formed at the outer edge of alignment shell 26 to facilitate stack assembly.

FIGS. 3 and 4 show how three modular one piece passage units 20A–20C, each initially having the construction shown for unit 20 in FIGS. 1 and 2, are assembled in a stack 21 in a concrete wall form. The form includes first and second form plates 31 and 32, usually wood; a wood alignment member 25, a short length of an ordinary 2×4, is mounted on the interior surface of the first form plate 31 at the desired location for a wall passage by appropriate means such as one or more nails 33, FIG. 3. The alignment shell portion of the first modular passage unit 20A (shell 26, FIG. 2) is cut off before unit 20A is mounted on form plate 31 as shown in FIG. 3. The alignment member 25, fitting into recess 24, serves to position unit 20A at the specific desired location for the wall passage; after unit 20A is in position on member 25 it is preferably further fixed in place by appropriate means such as six or more nails 34 driven toe-nail fashion through the rim of main shell 22A of unit 20A into form plate 31.

The next modular one piece passage unit 20B has its front closure wall 23 (FIG. 2) removed before it is incorporated in stack 21. The rear closure wall 29B, however, is retained as a part of unit 20B. Unit 20B is reversed in its orientation in stack 21 as compared to unit 20A; that is, the alignment shell 26B and its rear closure wall 29B face toward the first unit 20A and form wall 31, whereas the front rim of main shell 22B is oriented to face toward the second form wall 32. The third modular passage unit 20C in stack 21 is oriented the same way as unit 20B. Unit 20C still has both of its closure walls 23C and 29C. Closure wall 23C faces the inner surface of form wall 32.

From the spaced positions shown in FIG. 3, it is a simple matter to assemble the wall passage form, stack 21, as shown in FIG. 4, with all components moving to the left as indicated by arrow A in FIG. 3. Thus, with modular unit 20A mounted in place on concrete form plate 31, as described, unit 20B is moved to insert its alignment shell 26B into the main shell 22A of unit 20A (the rear wall of unit 20A was previously removed but wall 29B of unit 20B is still present). Unit 20C is similarly shifted to insert its alignment shell 26C into main shell 22B (the front wall of unit 20B was cut away but walls 29C and 23C remain intact). The second concrete form plate 32 is then brought into place against wall 23C, resulting in retention of the passage form stack 21 in the condition shown in FIG. 4. Tacking of plate 32 to unit 20C is not necessary, but can be done if desired. For wall passage stack 21, the overall wall width W is three times the main shell axial length L1. As will be apparent, the overall length of the passage form stack can be increased by using additional units oriented like unit 20B, the added passage units having their front walls removed. For a smaller wall width W, unit 20B can be omitted, with alignment shell 26C of unit 20C fitting into unit 20A. Length L1 need not be the same for each passage unit in stack 21; a couple of different lengths L1 (e.g., three and four inches) will permit the system of FIGS. 1–4 to accommodate most wall widths W. If necessary, one of the units can be cut to a shorter axial length L1 to enable match-up with an unusual wall width, but this rarely occurs.

With the passage form, stack 21, assembled and in place as shown in FIG. 4, the concrete 41 for the wall is poured, encompassing the passage form. When the concrete has set, the form plates 31 and 32 are removed in the usual way. Thereafter, all of the assembled passage units in stack 21 (units 20A–20C as shown in FIG. 4) are pulled out of the wall, leaving a clean, relatively smooth passage through the concrete wall. Of course, there may be tiny ring-shaped ridges inside of the wall passage, formed at the junctures 42 of the wall passage form units (FIG. 4), but these are so small as to be negligible. While the concrete 41 is being poured and set, the internal walls in stack 21 (walls 29B and 29C and walls 23A and 23C) provide support and structural integrity, assuring formation of a sleeveless, unlined wall passage of substantially uniform cross-section.

From the foregoing description of FIGS. 1–4, it will be seen that the invention, in this embodiment, provides an unlined passage of controlled size and configuration in a concrete wall when the wall is poured into a form, including first and second form plates 31 and 32 mounted in fixed relation to each other and separated by the width W. The invention is used as follows:

A. First, a plurality of modular one piece passage units like unit 20, FIGS. 1 and 2, are formed, each unit including an annular main shell 22 of external size and configuration conforming to a segment of the desired unlined passage through the concrete wall. Each unit 20 has an alignment shell 26 and end closure walls 23 and 29 that extend across and close the ends of the unit. Further, the main shell 22 of each modular unit has an axial length L1 less than W; in the stack 21 of FIGS. 3 and 4, W=3L1.

B. A first modular unit 20A is modified by cutting off its guide shell 26 (see FIG. 2) and then is mounted on the first form wall plate 31 at the location desired for the passage through the wall with one closure wall 23A of the first modular one piece unit 20A engaging the first form wall plate 31. Accurate location is determined by the 2×4 guide member 25 nailed to form member 31, which engages in recess 24 in wall 23A.

C. One or more additional modular units, such as units 20B and 20C, are next mounted in alignment on the first unit 20A to form a modular unit assembly or stack 21 having a total axial length 3L1 equal to the wall width W between the form wall plates 31 and 32. In this stack at least one closure wall (e.g., walls 29B and 29C) is located in the center of the stack. Moreover, a closure wall 23C of the last modular unit 20C, the unit farthest from the first modular unit 20A, faces outwardly of the stack and engages the second concrete form plate 32.

D. Finally, the second form plate 32 of the concrete form is mounted in engagement with the outer closure wall 23C of the last modular unit in stack 21.

FIGS. 5 and 6 illustrate the construction of a modular one piece passage unit 120 according to a second preferred embodiment of the invention. FIGS. 7 and 8 show three such units 120A–120C, on a reduced scale, in a wall passage stack 121. The assembled stack 121 will always include at least the two modular one piece passage units 120A and 120C at the ends of the stack; the number of units 120B in the middle of stack 121 can vary from zero to a substantial number, depending on the width W of the concrete wall (FIG. 8). FIGS. 5–8 are all part of one system and are described together.

The modular one piece passage unit 120, FIGS. 5 and 6, is of generally drum-like shape, including an annular main shell 122 of external diameter D1 and axial length L1. Diameter D1 becomes the internal diameter of the wall passage, as will be made apparent. As before, diameter D1 may range from a few inches up to several feet; maximum value for the system again is for wall passages requiring an internal diameter in excess of eighteen inches. Length L1, on the other hand, is usually best maintained at about two, three, or four inches so that virtually any wall thickness can be accommodated.

A front closure wall 123 closes off the front face of the main shell 122 of unit 120. At the center of closure wall 123 there is again a cross-shaped recess 124 having dimensions preferably such that a short length 125 of a conventional 2×4 wood stud fits into the recess. Recess 124 need not be cross shaped; a linear recess can be employed.

At the rear of unit 120, the right-hand end as shown in FIG. 6, there is an end closure wall 129. A long guide projection 126 of length L4 and diameter D5 extends axially outwardly from wall 129; a pair of shorter guide/alignment projections 127 of length L5 and diameter D5 also project axially outwardly from wall 129. Projection 126 is aligned with a cup-like recess or socket 128 in the front end closure wall 123. Recess 128 is symmetrical with a passage 131 through modular unit 120; see especially FIG. 5.
Projections 127, on the other hand, are disposed in alignment with two recesses or sockets 130 in wall 123, and the sockets 130 are arranged in a symmetrical pattern with two additional sockets 132. Each of the sockets or recesses 130, 131 and 132 has an internal diameter D4 approximately equal to or very slightly larger than the external diameter D5 of the guide projections 126 and 127.

FIGS. 7 and 8 show how three modular one piece passage units 120A–120C, each having the construction shown for unit 120 in FIGS. 5 and 6, are assembled in a stack 121 in a concrete wall form. The form includes first and second form plates 141 and 142, usually of wood. The wooden alignment member 125, again a short length of an ordinary 2×4, is mounted on the interior surface of the first form plate 141 at the desired location for a wall passage by appropriate means such as one or more nails 133, FIG. 7. Unit 120A has its guide/alignment projections 126A and 127A facing toward form plate 142, as shown in FIG. 7. After unit 120A is in position on member 125 it may be further fixed in place by appropriate means if desired.

The next modular passage unit 120B is aligned with unit 120A; its alignment recesses 128B and 130B fit onto the guide projections 126A and 127A of the first unit in stack 121. There can be more units 120B if required by the wall thickness W, or unit 120B could be eliminated in a narrow concrete wall. The last modular unit 120C in stack 121 is reversed in orientation, as compared to the units 120A and 120B, and is rotated 180° so that its sockets and its guide projections 126C and 127C interfit with the guide projections 126B and 127B and the recesses in the adjacent unit 120B.

From the spaced positions shown in FIG. 7, it is again a simple matter to assemble the wall passage form, stack 121, as shown in FIG. 8, with all components moving to the left as indicated by arrow A in FIG. 7. Thus, with modular unit 120A mounted in place on concrete form plate 141, as described, unit 120B is moved to accept the guide projection 126A into its alignment recess 128B and to receive the shorter guide projections 127A into its recesses 130B. Unit 120C is similarly shifted (arrow A) to insert its long guide projection 126C into the recess 131B and its shorter guide projections 127C into the recesses 132B of unit 120B. At the same time, projections 126B and 127B of unit 120B fit into recesses 131C and 132C, respectively. The second concrete form plate 142 is then brought into place against wall 123C, resulting in retention of the passage form stack 121 in the condition shown in FIG. 8. Tacking of plate 142 to unit 120C is not mandatory.

For wall passage stack 121, the overall wall width W is again the sum of the three main shell axial lengths L1. As will be apparent, the overall length of the passage form stack 121 can be increased by using one or more additional units oriented like either unit 120B or unit 120C. For a smaller wall width W, unit 120B can be omitted, unit 120C interfitting with unit 120A. Length L1 need not be the same for each passage unit in stack 121; a couple of different lengths L1 will again permit the system to accommodate most wall widths W.

With the passage form, stack 121, assembled and in place as shown in FIG. 8, the concrete 143 for the wall is poured, encompassing the stack. When the concrete has set, the form plates 141 and 142 are removed, as usual. Thereafter, all of the assembled modular units in stack 121 are pulled out of the wall, again leaving a clean, relatively smooth, unlined passage. Of course, there may again be tiny ring-shaped ridges inside of the wall passage, formed at the junctures of the wall passage form units, but these are so small as to be negligible. While the concrete 143 is being poured and set, the internal walls in stack 121 (walls 123 and 129 in all units) provide support and structural integrity, assuring formation of a sleeveless, unlined wall passage of substantially uniform cross-section.

From the foregoing description of FIGS. 5–8, it will be seen that this embodiment of the invention affords a technique for creating an unlined passage of controlled size and configuration in a concrete wall that comprises the following steps:

A. First, a plurality of modular one piece passage units like unit 120, FIGS. 5 and 6, are formed, each unit including an annular main shell 122 of external size and configuration conforming to a segment of the desired unlined passage through the concrete wall. Each unit 120 has end closure walls 123 and 129 extending across and closing the ends of its main shell section 122. Further, the main shell 122 of each modular unit has an axial length L1 less than W; in the stack 121 of FIG. 8, W=3L1.

B. A first modular unit 120A is mounted on the first form wall plate 141 at the location desired for the passage through the wall with one closure wall 123A engaging the first form wall plate 141. Accurate location is determined by the 2×4 guide member 125 nailed to form member 141, engaging in recess 124 in wall 123A.

C. One or more additional modular units, such as units 120B and 120C, are next mounted in alignment on the first unit 120A to form the modular unit assembly or stack 121 having a total axial length 3L1 equal to the wall width W between the form plates 141 and 142. In this stack at least one closure wall is located in the center of the stack; actually, as shown, there are several such walls 123 and 129 present. Moreover, an end closure wall 123C of the last modular unit 120C, the unit farthest from the first modular unit 120A, faces outwardly of stack 121 and engages the second concrete form plate 142.

D. Finally, the second form plate 142 of the concrete form is mounted in engagement with the outer closure wall 123C of the last modular unit in the stack 121.

A principal difference between the first system of FIGS. 1–4 and the second system, FIGS. 5–8, is that the modular one piece passage units 120 of the second system require no cutting; they are used as fabricated. Modular units 20 of the first system, on the other hand, except for the last unit 20C, FIGS. 3 and 4, must be cut to remove either the alignment shell 26 and rear closure wall 29 (unit 20A) or the front closure wall 23 (unit 20B). As a consequence, the system of FIGS. 5–8 is preferred. Both, however, produce a smooth, unlined passage through the concrete wall.

Figure 10:
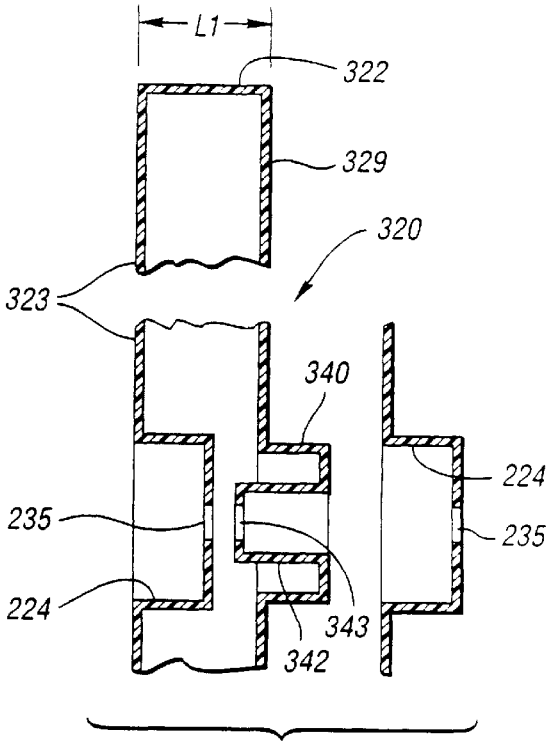
FIG. 10 is a sectional elevation view of a part of another embodiment of the modular one piece passage unit.
Figure 11:
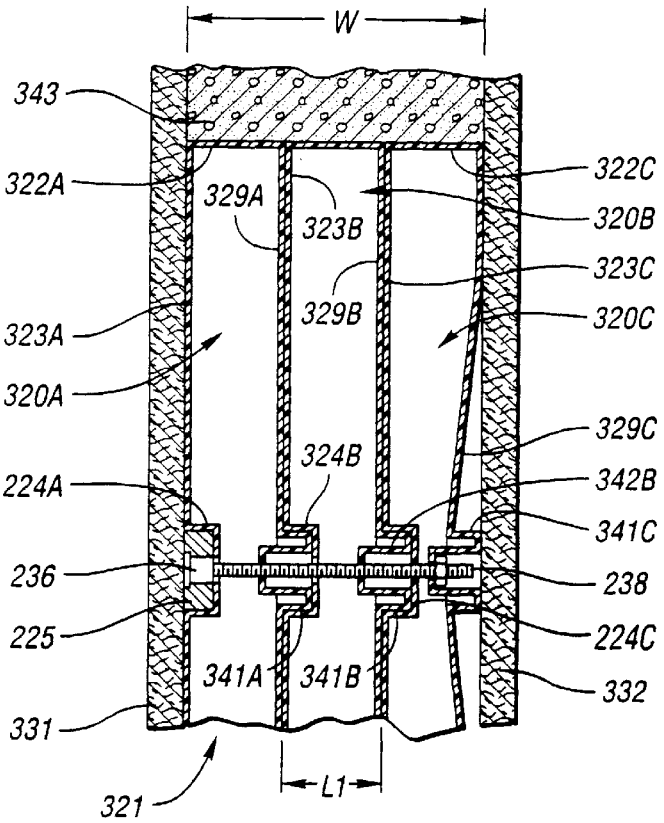
FIG. 11 is a sectional elevation view, on a reduced scale, of an assembled stack of modular one piece passage units like that of FIG. 10.

FIG. 9 illustrates a modification of the modular one piece passage unit 120 of FIGS. 5 and 6, a modification that is carried over, with minor additional change, into FIGS. 10 and 11. FIG. 9 shows a central portion of a modular one piece passage unit 220; the remainder of unit 220 may utilize the construction shown in FIGS. 5 and 6. In unit 220 the front wall 223 has a recess 224 that includes a central aperture 235. An alignment strip 225 fits into recess 224, as in the previously described systems. The alignment member 225, however, has a centrally mounted internally threaded prong nut 236 that lines up with the opening 235 in recess 224. Member 225 is again mounted on form plate 141 by suitable means such as nails 133.

The rear closure wall 229 of unit 220, FIG. 9, has a central aperture 237 that is aligned with opening 235 and with prong nut 236. This permits use of an elongated threaded rod 238 (only partly shown) to unite a plurality of the units 220 in a cohesive stack, supplementing the interlocking guide and alignment elements that are a part of each modular unit (see FIGS. 5 and 6).

FIG. 10 illustrates the construction of a modular one piece passage unit 320 according to another preferred embodiment of the invention. FIG. 11 shows three such units 320A, 320B, and 320C, on a reduced scale, in a wall passage stack in a form for pouring a concrete wall.

The modular one piece passage unit 320, FIG. 10 is of generally drum-like shape, including an annular main shell 322 of axial length L1. The outer diameter of unit 320, as before, becomes the internal diameter of the wall passage. Typically, the outside diameter of unit 320 may range from a few inches up to several feet; as in all of the systems of the invention, maximum advantages are achieved with wall passages requiring an internal diameter in excess of eighteen inches. Length L1 is usually best maintained at about two, three, or four inches so that virtually any wall thickness can be accommodated.

A front closure wall 323 closes off the front face of the main shell 322 of unit 320. At the center of closure wall 323 an alignment recess 224 having a central aperture 235 is formed in the closure wall. As before, the dimensions of recess 224 are preferably such that a short length of a conventional 2×4 wood stud fits into the recess. The rear end closure wall 329 of unit 320 includes a central guide projection 341 that is complementary to and fits into the alignment recess 224 of an adjacent unit. Guide projection 341 has a central re-entrant portion 342 with an aperture 343 aligned with the opening 235 in recess 224.

FIG. 11 shows how three modular one piece passage units 320A–320C, each having the construction shown for unit 320 in FIG. 10, are assembled in a stack 321 in a concrete wall form. The form includes first and second wood form plates 331 and 332. A wood alignment member 225 with a prong nut 236, as in FIG. 9, is mounted on the interior surface of the first form plate 331 at the desired location for a wall passage by appropriate means such as one or more nails. The alignment member 225, fitting into recess 224A, serves to position unit 320A at the specific desired location for the wall passage with its end closure wall 323A against form wall 331; after unit 320A is in position on member 225 it may be further fixed in place by appropriate means such as toe-nails (not shown) through the rim of its main shell 322A.

The next modular unit 320B in stack 321 has its front end closure wall 323B abutting the rear closure wall 329A. The recess 224B of unit 320B fits over the projection 341A on unit 320A for accurate alignment of units 320A and 320B. Similarly, the third modular passage unit 320C is mounted on unit 320B, with walls 329B and 323C abutting and recess 224C fitting over the guide projection 341B. A threaded rod 238 is then inserted through the center of the entire stack 321 and into prong nut 236 to complete the stack. The rear closure wall 329C of unit 320C is bowed somewhat so that form member 332 fits flat over the guide projection 341C. For stack 321, the wall width W is three times the main shell axial length L1. The overall length of stack 321 can be increased by using one or more additional modular units 320; like units 120, the modular units 320 require no cutting or other alteration. For a smaller wall width W, unit 320B can be omitted, unit 320C interfitting with unit 320A. Length L1 need not be the same for each passage unit in stack 321; a couple of different lengths L1 (e.g., three and four inches) will permit the system of FIGS. 1–4 to accommodate most wall widths.

With the passage form, stack 321, assembled and in place as shown in FIG. 11, the concrete 343 for the wall is poured, encompassing the passage form. When the concrete has set, the form plates 331 and 332 are removed, as usual. Thereafter, all of the assembled passage units in stack 321 are pulled out of the wall, leaving a clean, relatively smooth passage through the concrete wall. As before, there may be tiny ring-shaped ridges inside of the wall passage, formed at the junctures of the wall passage form units, but these are so small as to be negligible. While the concrete 343 is being poured and set, the internal walls 323 and 329 in stack 321 provide support and structural integrity, assuring formation of a sleeveless, unlined wall passage of substantially uniform cross-section.

From the foregoing description of FIGS. 9–11, it will be seen that this embodiment of the invention affords a system for of creating an unlined passage of controlled size and configuration in a concrete wall when the wall is poured into a form, affording the same fundamental advantages as the previously described embodiments. The system of FIGS. 9–11 does not require cutting or other alteration of the modular units, an advantage it shares with the system of FIGS. 5–8.

From the foregoing description of various embodiments, it will be clear that the invention provides a new and improved system for forming a smooth, unlined, sleeveless passage through a concrete wall, a passage well suited to installation of a wall seal closure such as that of Barton U.S. Pat. No. 3,528,668. The completed passage through the concrete wall is simple and inexpensive, and effectively avoids or minimizes the difficulties of the prior art as previously discussed.

The invention provides improved unitary, one-piece molded resin wall passage units that can be readily and inexpensively employed, with other such units, to form an improved wall passage assembly of extended length that can be used to form an unlined, sleeveless passage of consistent internal diameter through a concrete wall of virtually any thickness. The embodiments of FIGS. 5–11 are particularly advantageous because they are used with no need for cutting or other alteration. Each modular unit is a one-piece molded resin wall passage unit (a preferred resin is high density polyethylene) that can be joined to other such units in a stack, usually of large diameter, with the stack then used to form a passage of consistent internal diameter through a concrete wall. These modular unit stacks all eliminate any need for screws or other fasteners, minimize costs, and afford adequate structural integrity during pouring of a concrete wall. They cannot present a fire hazard because they are removed after the concrete wall has been poured and has set.

I claim:

1. A modular one piece passage unit adapted to be mounted in a concrete wall form with other such units to create a passage of controlled uniform size and configuration through a concrete wall molded in the concrete wall form, the concrete wall form including first and second form plates mounted in fixed spaced relation to each other with inner surfaces facing each other and separated by a spacing W, the modular passage unit being of generally drum-like configuration and comprising:

an annular main shell having a size and configuration conforming to an axial segment of the desired passage through the concrete wall and having a given axial length L1, with L1<W;

a front unit closure wall, closing off a front face of the main shell;

the front unit closure wall including means for mounting the modular passage unit in predetermined position on the inner surface of the first form plate of the concrete wall form with at least the outer annular edge of the modular passage unit sealed against that inner surface;

a rear unit closure wall closing off a rear face of the main shell;

and interlocking means for interconnecting the modular passage unit with a second modular passage unit of like size and configuration so that the main shells of the two passage units are aligned with and immediately contiguous with each other within the concrete wall form;

the main shell, the front unit closure wall, the mounting means, the rear unit closure wall, and the interlocking means all constituting a single, one piece integral unit.

2. A modular passage unit for creation of a passage through a concrete wall according to claim 1 in which:

the main shell has an outside diameter D1 conforming to the desired diameter for the passage and an inside diameter D2; and the interlocking means includes an alignment shell having an outside diameter of approximately D2 extending axially rearwardly from the main shell, so that the alignment shell of one modular unit fits into the main shell of an adjacent unit to interlock the two when the front closure wall of the adjacent unit is removed.

3. A modular passage unit for creation of a passage through a concrete wall according to claim 1 in which:

the interlocking means includes at least one alignment recess extending axially inwardly from the front closure wall of the modular unit;

and at least one guide projection projecting axially outwardly from the rear closure wall of the modular unit;

the guide projection being complementary to the alignment recess to be received in close fitting relation into that recess.

4. A modular passage unit for creation of a passage through a concrete wall according to claim 3, in which:

the modular unit has plural guide projections from the rear closure wall and plural alignment recesses in the front closure wall, each guide projection complementary to at least one alignment recess.

5. A modular passage unit for creation of a passage through a concrete wall according to claim 4, in which:

each modular unit further comprises plural alignment recesses in the rear closure wall so that one modular unit can be mounted on another in reversed orientation to afford a stack with two outwardly facing front closure walls.

6. A modular passage unit for creation of a passage through a concrete wall according to claim 5 in which:

the modular unit has at least one long guide projection of given length L4 and at least one short guide projection of given length L5, with L4>L5.

7. A modular passage unit for creation of a passage through a concrete wall according to claim 1 in which:

each modular unit includes an alignment recess, extending axially inwardly from the front closure wall of the modular unit, having a size and configuration to receive a strip of a standard wood structural shape in close interfitting relation.

8. A modular passage unit for creation of a passage through a concrete wall according to claim 7 in which:

a guide projection projecting axially outwardly from the rear closure wall of the modular unit has a size and configuration corresponding to the strip of a standard wood structural shape.

9. A modular passage unit for creation of a passage through a concrete wall according to claim 8 and further comprising:

a first opening in the alignment recess; and a second opening, aligned with the first opening, in the guide projection;

so that a tie rod can be inserted through all of such openings to unite several modular units in a unified, aligned stack.

10. A system of modular one piece passage units to be mounted in a concrete wall form with other such units, in a coherent stack, to create an unlined passage of uniform diameter D1 through a concrete wall molded in the concrete wall form, the concrete wall form including first and second form plates mounted in fixed spaced relation to each other with inner surfaces facing each other and separated by a spacing W, the system comprising a plurality of modular passage units;

each modular unit being of generally drum-like configuration and each unit comprising:

an annular main shell having an outside diameter D1 and an axial length L1, with L1<W;

a front unit closure wall, closing off a front face of the main shell;

the front unit closure wall including mounting means for mounting the modular passage unit in predetermined position on the inner surface of the first form plate of a concrete wall form with at least the outer annular edge of the modular passage unit sealed against that inner surface;

a rear unit closure wall closing off a rear face of the main shell;

and interlocking means for interconnecting the modular passage unit with a second modular passage unit of like size and configuration so that the main shells of the two passage units are aligned with and immediately contiguous with each other in a coherent stack within the concrete wall form, with at least one closure wall present in the stack spaced from the inner surfaces of both form plates of the concrete form;

the main shell, the front unit closure wall, the mounting means, the rear unit closure wall, and the interlocking means all constituting a single one piece integral structure in each unit;

the main shells of some of the passage units having an axial length L1 of approximately three inches;

and the main shells of other passage units having an axial length of approximately four inches.

11. A system of modular passage units for creation of an unlined passage of diameter D1 through a concrete wall according to claim 10 in which each of the modular passage units is formed in one piece entirely of molded resin.

12. A system of modular passage units for creation of an unlined passage of diameter D1 through a concrete wall according to claim 10 in which the mounting means in each modular passage unit comprises a recess in the front unit closure wall for receiving, in close fitting relation, a guide strip comprising a short length of several inches of a standard construction stud.

13. A system of modular passage units for creation of an unlined passage of diameter D1 through a concrete wall according to claim 10 in which the interlocking means in each modular passage unit comprises at least one alignment recess extending axially inwardly from the front closure wall of the modular unit and at least one guide projection projecting axially outwardly from the rear closure wall of the modular unit;

the guide projection being complementary to the alignment recess so as to be received in close fitting relation into that recess in another unit.

14. A system of modular passage units for creation of an unlined passage of diameter D1 through a concrete wall according to claim 13 in which:

each modular unit has plural guide projections from the rear closure wall and plural alignment recesses in the front closure wall, each guide projection complementary to at least one alignment recess; and each modular unit further comprises plural alignment recesses in the rear closure wall so that one modular unit can be mounted on another in reversed orientation to afford a stack with two outwardly facing front closure walls.

* * * * *